US008337292B2

(12) United States Patent
Nores

(10) Patent No.: US 8,337,292 B2
(45) Date of Patent: Dec. 25, 2012

(54) SLOT MACHINE GAME WITH SIDE WAGER ON REEL ORDER

(75) Inventor: Alvaro Nores, Buenos Aries (AR)

(73) Assignee: Etasse Limited, Alderney, Channel Islands (VG)

( * ) Notice: Subject to any disclaimer, the term of this patent is extended or adjusted under 35 U.S.C. 154(b) by 953 days.

(21) Appl. No.: 11/860,524

(22) Filed: Sep. 24, 2007

(65) Prior Publication Data

US 2008/0119260 A1 May 22, 2008

Related U.S. Application Data

(60) Provisional application No. 60/865,170, filed on Nov. 10, 2006.

(51) Int. Cl.
*A63F 9/24* (2006.01)

(52) U.S. Cl. ..... 463/20; 463/21

(58) Field of Classification Search ..... 463/20, 463/21

See application file for complete search history.

(56) References Cited

U.S. PATENT DOCUMENTS

| | | | |
|---|---|---|---|
| 4,836,546 | A | 6/1989 | DiRe et al. |
| 5,033,744 | A | 7/1991 | Bridgeman et al. |
| 5,342,049 | A | 8/1994 | Wichinsky et al. |
| 5,401,023 | A | 3/1995 | Wood |
| 5,401,024 | A | 3/1995 | Simunek |
| 5,411,271 | A | 5/1995 | Mirando |
| 5,456,465 | A | 10/1995 | Durham |
| 5,511,781 | A | 4/1996 | Wood et al. |
| 5,704,835 | A | 1/1998 | Dietz, II |
| 5,720,662 | A | 2/1998 | Holmes et al. |
| 5,769,716 | A | 6/1998 | Saffari et al. |
| 5,823,874 | A | 10/1998 | Adams |
| 5,833,537 | A | 11/1998 | Barrie |
| 5,947,821 | A | 9/1999 | Stone |
| 5,976,016 | A | 11/1999 | Moody et al. |
| 6,001,016 | A | 12/1999 | Walker et al. |
| 6,015,346 | A | 1/2000 | Bennett |
| 6,070,874 | A | 6/2000 | Ivers |
| 6,120,298 | A | 9/2000 | Jenkins et al. |

(Continued)

FOREIGN PATENT DOCUMENTS

EP 1063622 12/2000

(Continued)

OTHER PUBLICATIONS

European Patent Office, Supplementary European Search Report for European Application No. EP 06 71 8145, Apr. 30, 2010.

(Continued)

*Primary Examiner* — Pierre E Elisca

(74) *Attorney, Agent, or Firm* — McDonnell Boehnen Hulbert & Berghoff LLP

(57) ABSTRACT

A slot machine method, apparatus, and computer readable storage to allow a player to make a side wager on a slot machine game. The side wager is based on a finishing order of the reels of the slot machine, which will stop spinning in a random order instead of the typical left to right order. The player can predict (or be presented with) a predicted order, and the predicted order is compared to an actual stopping order after the reels are spun to determine if the side wager is a winner, and for how much.

19 Claims, 4 Drawing Sheets

U.S. PATENT DOCUMENTS

| | | | |
|---|---|---|---|
| 6,129,632 | A | 10/2000 | Luciano |
| 6,159,097 | A | 12/2000 | Gura |
| 6,174,235 | B1 | 1/2001 | Walker et al. |
| 6,186,894 | B1 | 2/2001 | Mayeroff |
| 6,193,606 | B1 | 2/2001 | Walker et al. |
| 6,210,275 | B1 | 4/2001 | Olsen |
| 6,224,483 | B1 | 5/2001 | Mayeroff |
| 6,270,409 | B1 | 8/2001 | Shuster |
| 6,287,197 | B1 | 9/2001 | Dickinson et al. |
| 6,338,678 | B1 | 1/2002 | Seelig et al. |
| 6,346,043 | B1 | 2/2002 | Colin et al. |
| 6,347,996 | B1 | 2/2002 | Gilmore et al. |
| 6,358,147 | B1 | 3/2002 | Jaffe et al. |
| 6,390,473 | B1 | 5/2002 | Vancura et al. |
| 6,394,899 | B1 | 5/2002 | Walker |
| 6,413,161 | B1 | 7/2002 | Baerlocher et al. |
| 6,425,824 | B1 | 7/2002 | Baerlocher et al. |
| 6,450,888 | B1 | 9/2002 | Takase et al. |
| 6,485,367 | B1 | 11/2002 | Joshi |
| 6,547,242 | B1 | 4/2003 | Sugiyama et al. |
| 6,554,283 | B2 | 4/2003 | Vancura et al. |
| 6,575,831 | B1 | 6/2003 | Gonen et al. |
| 6,595,854 | B2 | 7/2003 | Hughs-Baird et al. |
| 6,601,850 | B1 | 8/2003 | Ross |
| 6,604,740 | B1 | 8/2003 | Singer et al. |
| 6,609,974 | B2 | 8/2003 | Mead et al. |
| 6,641,477 | B1 | 11/2003 | Dietz et al. |
| 6,663,489 | B2 | 12/2003 | Baerlocher et al. |
| 6,666,765 | B2 | 12/2003 | Vancura |
| 6,669,559 | B1 | 12/2003 | Baerlocher et al. |
| 6,695,696 | B1 | 2/2004 | Kaminkow |
| 6,709,332 | B2 | 3/2004 | Adams |
| 6,731,313 | B1 | 5/2004 | Kaminkow |
| 6,752,396 | B2 | 6/2004 | Smith |
| 6,769,986 | B2 | 8/2004 | Vancura |
| 6,780,107 | B2 | 8/2004 | Baerlocher et al. |
| 6,811,486 | B1 | 11/2004 | Luciano, Jr. |
| 6,830,514 | B2 | 12/2004 | Meyer et al. |
| 6,855,054 | B2 | 2/2005 | White et al. |
| 6,860,810 | B2 | 3/2005 | Cannon et al. |
| 6,863,606 | B1 | 3/2005 | Berg et al. |
| 6,869,360 | B2 | 3/2005 | Marks et al. |
| 6,884,165 | B2 | 4/2005 | Baerlocher |
| 6,890,257 | B2 | 5/2005 | Baerlocher |
| 6,896,260 | B2 | 5/2005 | Pierce |
| 6,902,481 | B2 | 6/2005 | Breckner et al. |
| 6,938,068 | B1 | 8/2005 | Kraft et al. |
| 6,939,223 | B1 | 9/2005 | Jones |
| 6,942,568 | B2 | 9/2005 | Baerlocher |
| 6,942,571 | B1 | 9/2005 | McAllister et al. |
| 6,950,993 | B2 | 9/2005 | Breinberg |
| 6,964,416 | B2 | 11/2005 | McClintic et al. |
| 6,966,836 | B1 | 11/2005 | Rush et al. |
| 6,984,174 | B2 | 1/2006 | Cannon et al. |
| 6,991,539 | B2 | 1/2006 | Pacey |
| 6,997,805 | B2 | 2/2006 | Vancura |
| 7,036,083 | B1 | 4/2006 | Zenith |
| 7,066,811 | B1 | 6/2006 | DeFrees-Parrott et al. |
| 7,147,559 | B2 | 12/2006 | Englman |
| 7,175,527 | B2 | 2/2007 | Bryant |
| 7,192,346 | B2 | 3/2007 | Mathis |
| 7,252,589 | B1 | 8/2007 | Marks et al. |
| 7,264,545 | B2 | 9/2007 | Maya et al. |
| 7,275,989 | B2 | 10/2007 | Moody |
| 7,326,115 | B2 | 2/2008 | Baerlocher |
| 7,341,513 | B2 | 3/2008 | Cuddy et al. |
| 7,364,506 | B2 | 4/2008 | Jaffe et al. |
| 7,367,883 | B2 | 5/2008 | Gagnon |
| 7,371,173 | B2 | 5/2008 | Gatto et al. |
| 7,377,850 | B2 | 5/2008 | Shackelford et al. |
| 7,393,278 | B2 | 7/2008 | Gerson et al. |
| 7,470,193 | B2 | 12/2008 | Umezaki |
| 7,534,168 | B2 | 5/2009 | Bennett et al. |
| 7,559,836 | B2 | 7/2009 | Gerson et al. |
| 7,585,219 | B2 | 9/2009 | Randall et al. |
| 7,631,872 | B2 | 12/2009 | Roemer et al. |
| 7,690,996 | B2 | 4/2010 | Iddings et al. |
| 7,713,123 | B2 | 5/2010 | Gerson et al. |
| 7,727,063 | B2 | 6/2010 | Walker et al. |
| 7,753,790 | B2 | 7/2010 | Nguyen et al. |
| 7,819,748 | B2 | 10/2010 | Ajioka |
| 2001/0003709 | A1 | 6/2001 | Adams |
| 2001/0009865 | A1 | 7/2001 | Demar et al. |
| 2001/0031659 | A1 | 10/2001 | Perrie et al. |
| 2002/0010017 | A1 | 1/2002 | Bennett |
| 2002/0027323 | A1 | 3/2002 | Vancura et al. |
| 2002/0043759 | A1 | 4/2002 | Vancura |
| 2002/0045474 | A1 | 4/2002 | Singer et al. |
| 2002/0049082 | A1 | 4/2002 | Bansemer et al. |
| 2002/0052234 | A1 | 5/2002 | Adams |
| 2002/0058545 | A1 | 5/2002 | Luciano |
| 2002/0077165 | A1 | 6/2002 | Bansemer et al. |
| 2003/0003980 | A1 | 1/2003 | Moody |
| 2003/0013514 | A1 | 1/2003 | Cregan et al. |
| 2003/0022711 | A1 | 1/2003 | Locke et al. |
| 2003/0027619 | A1 | 2/2003 | Nicastro |
| 2003/0027639 | A1 | 2/2003 | Peterson et al. |
| 2003/0060276 | A1 | 3/2003 | Walker et al. |
| 2003/0060278 | A1 | 3/2003 | Walker et al. |
| 2003/0060281 | A1 | 3/2003 | Vancura |
| 2003/0064782 | A1 | 4/2003 | Beaulieu et al. |
| 2003/0064797 | A1 | 4/2003 | Jackson et al. |
| 2003/0064800 | A1 | 4/2003 | Jackson et al. |
| 2003/0092476 | A1 | 5/2003 | Fox |
| 2003/0092480 | A1 | 5/2003 | White et al. |
| 2003/0100361 | A1 | 5/2003 | Sharpless et al. |
| 2003/0119576 | A1 | 6/2003 | McClintic et al. |
| 2003/0119581 | A1 | 6/2003 | Cannon et al. |
| 2003/0125107 | A1 | 7/2003 | Cannon |
| 2003/0130027 | A1 | 7/2003 | Aida |
| 2003/0153375 | A1 | 8/2003 | Vancura |
| 2003/0162584 | A1 | 8/2003 | Hughs-Baird et al. |
| 2003/0181231 | A1 | 9/2003 | Vancura et al. |
| 2003/0186733 | A1 | 10/2003 | Wolf et al. |
| 2003/0195027 | A1 | 10/2003 | Baerlocher et al. |
| 2003/0195034 | A1 | 10/2003 | Dunaevsky |
| 2003/0224849 | A1 | 12/2003 | Geiger |
| 2004/0014517 | A1 | 1/2004 | Inoue |
| 2004/0023715 | A1 | 2/2004 | Luciano, Jr. |
| 2004/0036216 | A1 | 2/2004 | Vancura |
| 2004/0048650 | A1 | 3/2004 | Mierau et al. |
| 2004/0053657 | A1 | 3/2004 | Fiden et al. |
| 2004/0053683 | A1 | 3/2004 | Hartl et al. |
| 2004/0063483 | A1 | 4/2004 | Wolf et al. |
| 2004/0072603 | A1 | 4/2004 | Shuster |
| 2004/0092300 | A1 | 5/2004 | Gauselmann |
| 2004/0116173 | A1 | 6/2004 | Baerlocher |
| 2004/0121838 | A1 | 6/2004 | Hughs-Baird et al. |
| 2004/0127280 | A1 | 7/2004 | Moody |
| 2004/0152509 | A1 | 8/2004 | Hornik et al. |
| 2004/0176157 | A1 | 9/2004 | Walker et al. |
| 2004/0198490 | A1 | 10/2004 | Bansemer et al. |
| 2004/0204233 | A1 | 10/2004 | Saffari et al. |
| 2004/0209662 | A1 | 10/2004 | Wadleigh |
| 2004/0219969 | A1 | 11/2004 | Casey et al. |
| 2004/0235548 | A1 | 11/2004 | Benbrahim |
| 2004/0235556 | A1 | 11/2004 | Flemming et al. |
| 2004/0242316 | A1 | 12/2004 | Oles et al. |
| 2005/0014551 | A1 | 1/2005 | Packes et al. |
| 2005/0014557 | A1 | 1/2005 | Duhamel |
| 2005/0014563 | A1 | 1/2005 | Barri |
| 2005/0026664 | A1 | 2/2005 | Bansemer et al. |
| 2005/0026679 | A1 | 2/2005 | Lucchesi et al. |
| 2005/0032566 | A1 | 2/2005 | Baerlocher et al. |
| 2005/0033711 | A1 | 2/2005 | Horvitz et al. |
| 2005/0054430 | A1 | 3/2005 | Pitman et al. |
| 2005/0085285 | A1 | 4/2005 | Muskin |
| 2005/0090307 | A1 | 4/2005 | Walker et al. |
| 2005/0107154 | A1 | 5/2005 | Pacey |
| 2005/0119040 | A1 | 6/2005 | Berman et al. |
| 2005/0130737 | A1 | 6/2005 | Englman et al. |
| 2005/0137007 | A1 | 6/2005 | Schaufelberger |
| 2005/0153765 | A1 | 7/2005 | Shoostine |
| 2005/0153770 | A1 | 7/2005 | Vancura |
| 2005/0164794 | A1 | 7/2005 | Tahara |
| 2005/0176494 | A1 | 8/2005 | Thomas |
| 2005/0181866 | A1 | 8/2005 | Baerlocher |

| | | | | |
|---|---|---|---|---|
| 2005/0187005 | A1 | 8/2005 | Rose | |
| 2005/0202864 | A1 | 9/2005 | Duhamel et al. | |
| 2005/0202869 | A1 | 9/2005 | Miyamoto et al. | |
| 2005/0215311 | A1 | 9/2005 | Hornik et al. | |
| 2005/0266916 | A1 | 12/2005 | Sato et al. | |
| 2005/0277469 | A1 | 12/2005 | Pryzby et al. | |
| 2006/0003831 | A1 | 1/2006 | Falciglia, Sr. | |
| 2006/0019738 | A1 | 1/2006 | Baerlocher et al. | |
| 2006/0030398 | A1 | 2/2006 | Hornick | |
| 2006/0046818 | A1 | 3/2006 | Goins | |
| 2006/0046853 | A1 | 3/2006 | Black | |
| 2006/0073863 | A1 | 4/2006 | Hagiwara | |
| 2006/0073878 | A1 | 4/2006 | Shackelford et al. | |
| 2006/0121972 | A1 | 6/2006 | Walker et al. | |
| 2006/0121978 | A1 | 6/2006 | Hornick et al. | |
| 2006/0160595 | A1 | 7/2006 | Gerson et al. | |
| 2006/0160614 | A1 | 7/2006 | Walker et al. | |
| 2006/0172791 | A1 | 8/2006 | Wolf | |
| 2006/0181028 | A1 | 8/2006 | Benator | |
| 2006/0183536 | A1 | 8/2006 | Gagner et al. | |
| 2006/0189377 | A1 | 8/2006 | Gomez et al. | |
| 2006/0189378 | A1 | 8/2006 | Aoki | |
| 2006/0205483 | A1* | 9/2006 | Meyer et al. | 463/25 |
| 2006/0240890 | A1* | 10/2006 | Walker et al. | 463/23 |
| 2006/0252494 | A1 | 11/2006 | Gerson et al. | |
| 2006/0252495 | A1 | 11/2006 | Gerson et al. | |
| 2006/0264255 | A1 | 11/2006 | Borissov | |
| 2007/0060254 | A1 | 3/2007 | Muir | |
| 2007/0060314 | A1 | 3/2007 | Baerlocher et al. | |
| 2007/0077988 | A1 | 4/2007 | Friedman | |
| 2007/0087805 | A1 | 4/2007 | Taylor | |
| 2007/0102877 | A1* | 5/2007 | Personius et al. | 273/138.2 |
| 2007/0161424 | A1 | 7/2007 | Gatto et al. | |
| 2007/0167217 | A1 | 7/2007 | Kaminkow et al. | |
| 2007/0281774 | A1 | 12/2007 | Khal | |
| 2007/0287523 | A1 | 12/2007 | Esses et al. | |
| 2008/0045295 | A1 | 2/2008 | Walker et al. | |
| 2008/0076513 | A1 | 3/2008 | Esses et al. | |
| 2008/0076518 | A1 | 3/2008 | Yoshizawa | |
| 2008/0102923 | A1 | 5/2008 | Esses et al. | |
| 2008/0113769 | A1 | 5/2008 | Montero et al. | |
| 2008/0119260 | A1 | 5/2008 | Nores | |
| 2008/0119261 | A1 | 5/2008 | Heymann | |
| 2008/0153570 | A1 | 6/2008 | Esses et al. | |
| 2008/0167116 | A1 | 7/2008 | Gerson | |
| 2008/0214292 | A1 | 9/2008 | Bryant et al. | |
| 2008/0234032 | A1 | 9/2008 | Brunet de Courssou et al. | |
| 2008/0274798 | A1* | 11/2008 | Walker et al. | 463/25 |
| 2008/0310302 | A1 | 12/2008 | Detwiler et al. | |
| 2008/0318660 | A1 | 12/2008 | Nores | |
| 2009/0005145 | A1 | 1/2009 | White | |
| 2009/0029773 | A1 | 1/2009 | Cherry | |
| 2009/0029779 | A1 | 1/2009 | Murase et al. | |
| 2009/0061982 | A1 | 3/2009 | Brito | |
| 2009/0064000 | A1 | 3/2009 | Garbow et al. | |
| 2009/0093296 | A1 | 4/2009 | Gerson et al. | |
| 2009/0104977 | A1 | 4/2009 | Zielinski | |
| 2009/0124328 | A1 | 5/2009 | Nores | |
| 2009/0124352 | A1 | 5/2009 | Gerson | |
| 2009/0286586 | A1 | 11/2009 | Heymann et al. | |
| 2010/0004048 | A1 | 1/2010 | Brito | |
| 2010/0029376 | A1 | 2/2010 | Hardy et al. | |
| 2010/0029378 | A1 | 2/2010 | Gerson et al. | |
| 2010/0048284 | A1 | 2/2010 | Jaffe | |
| 2010/0210356 | A1 | 8/2010 | Losica | |
| 2010/0240456 | A1* | 9/2010 | Goto et al. | 463/30 |
| 2010/0331071 | A1* | 12/2010 | Uchiyama et al. | 463/19 |
| 2011/0281627 | A1* | 11/2011 | Lutnick et al. | 463/13 |
| 2012/0052939 | A1* | 3/2012 | Lutnick et al. | 463/25 |

FOREIGN PATENT DOCUMENTS

| | | | |
|---|---|---|---|
| EP | 1652562 | | 5/2006 |
| GB | 2148037 | | 5/1985 |
| GB | 2335524 | | 9/1999 |
| WO | 2006076424 | A3 | 7/2006 |
| WO | 2006076462 | A3 | 7/2006 |
| WO | 2007076514 | A3 | 7/2007 |
| WO | 2007143704 | A3 | 12/2007 |
| WO | 2008039413 | A3 | 4/2008 |
| WO | 2008051518 | A3 | 5/2008 |
| WO | 2008057188 | | 5/2008 |
| WO | 2008057201 | A3 | 5/2008 |
| WO | 2008060472 | A3 | 5/2008 |
| WO | 2008060473 | A3 | 5/2008 |
| WO | 2009032130 | A3 | 3/2009 |

OTHER PUBLICATIONS

Illinois Lottery Office of the Superintendent Game Rules, Downloaded from the World Wide Web at http://webarchive.org/web/w0061109031843/http://www.illinoislottery.com/subsections/OnLineRules.htm, downloaded on Sep. 28, 2011 as archived on Nov. 9, 2006.

International Search Report, PCT/US2007/023658, Sep. 22, 2008.

International Search Report and Written Opinion, PCT/US2007/022775 (counterpart application to U.S. Appl. No. 11/776,508), Aug. 15, 2008.

International Searching Authority/U.S. Patent Office, International Search Report for PCT/US08/10156, Jun. 25, 2009.

International Searching Authority/U.S. Patent Office, Written Opinion of the International Searching Authority for International Application No. PCT/US07/22425, Jul. 24, 2008.

International Searching Authority/U.S. Patent Office, Written Opinion of the International Searching Authority (revised) for International Application No. PCT/US07/23656, Aug. 25, 2008.

International Searching Authority/U.S. Patent Office, Written Opinion of the International Searching Authority for International Application No. PCT/US07/23658, Sep. 22, 2008.

Lim, Seno Heno, USPTO Office Action dated Jun. 9, 2008.

"Nintendogs" instruction booklet by Nintendo of America, Inc., http://www.nintendo.com/consumer/gameslist/manuals/DS_Nintendogs.pdf, Jul. 15, 2005.

PCT Search Report and Opinion, PCT/US2007/022425, Jul. 24, 2008.

PCT/US2006/062630, PCT Search Report and Opinion, Mar. 17, 2008.

PCT/US2007/023656 Search Report and Opinion, Aug. 25, 2008.

PCT/U82007/070550, International Search Report, Sep. 16, 2008.

PCT/US2007/074030, Search Report and Opinion, Sep. 26, 2008.

PCT/U82008/010156, International Search Report, Jun. 25, 2009.

The International Bureau of WIPO, International Preliminary Report on Patentability and Written Opinion of the International Searching Authority for International Application PCT/US2006/000346, Jun. 15, 2006.

The International Bureau of WIPO, International Preliminary Report on Patentability and Written Opinion of the International Searching Authority for International Application PCT/US2006/001034, Nov. 7, 2007.

The International Bureau of WIPO, International Preliminary Report on Patentability and Written Opinion of the International Searching Authority for International Application PCT/US2006/062630, Mar. 17, 2008.

The International Bureau of WIPO, International Preliminary Report on Patentability and Written Opinion of the International Searching Authority for International Application PCT/US2007/20589, Apr. 1, 2008.

The International Bureau of WIPO, International Preliminary Report on Patentability and Written Opinion of the International Searching Authority for International Application PCT/US2007/022425, Jul. 24, 2008.

The International Bureau of WIPO, International Preliminary Report on Patentability and Written Opinion of the International Searching Authority for International Application PCT/US2007/022426, May 21, 2008.

The International Bureau of WIPO, International Preliminary Report on Patentability and Written Opinion of the International Searching Authority for International Application PCT/US2007/022775, Aug. 15, 2008.

The International Bureau of WIPO, International Preliminary Report on Patentability and Written Opinion of the International Searching Authority for International Application PCT/US2007/023657, Sep. 29, 2008.

The International Bureau of WIPO, International Preliminary Report on Patentability and Written Opinion of the International Searching Authority for International Application PCT/US2007/023658, Sep. 22, 2008.
Translated Office Action in Macau Economy Bureau, application No. 1/0004388(880), Apr. 17, 2009.
Wikipedia, "Wheel of Fortune," http://en.wikipedia.org/wiki/Wheel_of_Fortune, printed Dec. 8, 2008.
World Intellectual Property Organization—International Bureau, International Search Report for International Application No. PCT/US06/01034, Nov. 7, 2007.
World Intellectual Property Organization—International Bureau, International Search Report for International Application No. PCT/US06/62630, Mar. 17, 2008.
World Intellectual Property Organization—International Bureau, International Search Report for International Application No. PCT/US07/022425, Jul. 24, 2008.
World Intellectual Property Organization—International Bureau, International Search Report for International Application No. PCT/US07/022426, May 28, 2008.
World Intellectual Property Organization—International Bureau, International Search Report for International Application No. PCT/US07/20589, Apr. 1, 2008.
World Intellectual Property Organization—International Bureau, International Search Report for International Application No. PCT/US07/23657, Sep. 29, 2008.
PCT/US06/01034—WO/2006/076462 (counterpart PCT application), International Search Report, Written Opinion of the International Search Authority, Nov. 7, 2007.
U.S. Appl. No. 11/326,125, filed Jan. 3, 2006.
U.S. Appl. No. 11/337,960, filed Jan. 23, 2006.
U.S. Appl. No. 11/558,405, filed Nov. 9, 2006.
U.S. Appl. No. 11/609,315, filed Dec. 11, 2006.
U.S. Appl. No. 11/678,050, filed Feb. 22, 2007.
U.S. Appl. No. 11/764,689, filed Jun. 18, 2007.
U.S. Appl. No. 11/776,508, filed Jul. 11, 2007.
U.S. Appl. No. 11/781,941, filed Jul. 23, 2007.
U.S. Appl. No. 11/846,239, filed Aug. 28, 2007.
U.S. Appl. No. 12/773,847.
U.S. Appl. No. 11/873,740, filed Oct. 17, 2007.
U.S. Appl. No. 11/874,409, filed Oct. 18, 2007.
U.S. Appl. No. 11/928,413, filed Oct. 30, 2007.
U.S. Appl. No. 11/949,749, filed Dec. 3, 2007.
U.S. Appl. No. 11/952,470, filed Dec. 7, 2007.
U.S. Appl. No. 12/107,255, filed Apr. 22, 2008.
U.S. Appl. No. 12/122,110, filed May 16, 2008.
U.S. Appl. No. 12/165,335, filed Jun. 30, 2008.
U.S. Appl. No. 12/168,878, filed Jul. 7, 2008.
U.S. Appl. No. 12/495,774, filed Jun. 30, 2009.
Sony Pictures Television—Wheel of Fortune 20th Anniversary—downloaded from http://webarchive.org/web/20030624010929/http://www.wheeloffortune.com/, Jun. 24, 2003.

* cited by examiner

SLOT MACHINE GAME WITH SIDE WAGER ON REEL ORDER

CROSS REFERENCE TO RELATED APPLICATIONS

This Application claims benefit of provisional application 60/865,170, filed Nov. 10, 2006, which is incorporated by reference herein in its entirety.

This Application is also related to the following ten applications identified by their application number, all nine applications are incorporated by reference herein in their entireties: Ser. No. 11/035,691 ("Slot Machine Game that Allows Player to Purchase Reel Respins"); Ser. No. 11/326,125 ("Slot Machine Bonus Game); Ser. No. 11/337,960 ("Slot Machine with Skill Aspect"); Ser. No. 11/558,405 ("System and Method for Allowing Piggyback Wagering"); Ser. No. 11/609,315 ("System and Method for Allowing Piggyback Wagering"); Ser. No. 11/459,253 ("Slot Machine Bonus Game"); Ser. No. 11/558,564 ("System and Method for Administering a Progressive Jackpot Limited to a Bonus Round"); Ser. No. 11/11/9678,050 ("Slot Machine Game With Additional Features"); Ser. No. 11/764,689 ("Slot Machine Game with Additional Award Indicator"); and Ser. No. 11/776,508 ("Slot Machine Game With User Selectable Themes"). All ten of these applications are incorporated by reference herein in their entireties for all purposes. Any and all features of any of these applications can be combined with each other and with any feature(s) described herein.

BACKGROUND OF THE INVENTION

1. Field of the Invention

The present inventive concept relates to a system, method, and computer readable storage, for providing additional themes to slot machine games.

2. Description of the Related Art

Slot machine games are a billion dollar industry. The current three or five reel machines have been around for a long time and some players may find current game play monotonous.

What is needed is a slot machine with additional slot machine features which will generate more excitement for players and/or more revenue as well.

SUMMARY OF THE INVENTION

It is an aspect of the present general inventive concept to provide additional features to slot machine games.

The above aspects can also be obtained by a method that includes (a) receiving a side wager from a player; (b) identifying a predicted order that slot reels will stop spinning; (c) spinning the slot reels and stopping the slot reels in an actual order determined randomly; (d) comparing the predicted order to the actual order; and (e) determining whether the side wager wins based on the comparing, and if the side wager wins, then paying a winning side wager payout to the player (f) wherein a main wager is also placed by the player before the spinning and paid according to symbol combinations on the reels after the spinning.

The above aspects can also be obtained by a method that includes (a) receiving a side wager from a player; (b) inputting, from the player, a first predicted reel and a second predicted reel; (c) receiving a main wager from the player; (d) spinning the slot reels and stopping the slot reels in an actual order; (e) if it is determined that either (the first predicted reel stopped first during the spinning and the second predicted reel stopped second during the spinning) or (the second predicted reel stopped first during the spinning and the first predicted reel stopped second during the spinning), then the player wins a payout on the side wager, otherwise the player loses the side wager.

The above aspects can also be obtained by a method that includes (a) inputting, from the player, a subset of reels on a slot machine game and a predicted finishing order of the subset; (b) receiving a main wager from the player and a side wager from the player; (c) spinning the slot reels and stopping the slot reels in an actual stopping order; (d) comparing the actual stopping order of the subset to the predicting finishing order of the subset; (e) paying a payout on the side wager to the player based on the comparing; and (f) paying an additional payout on the main wager based on reel positions after the spinning.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
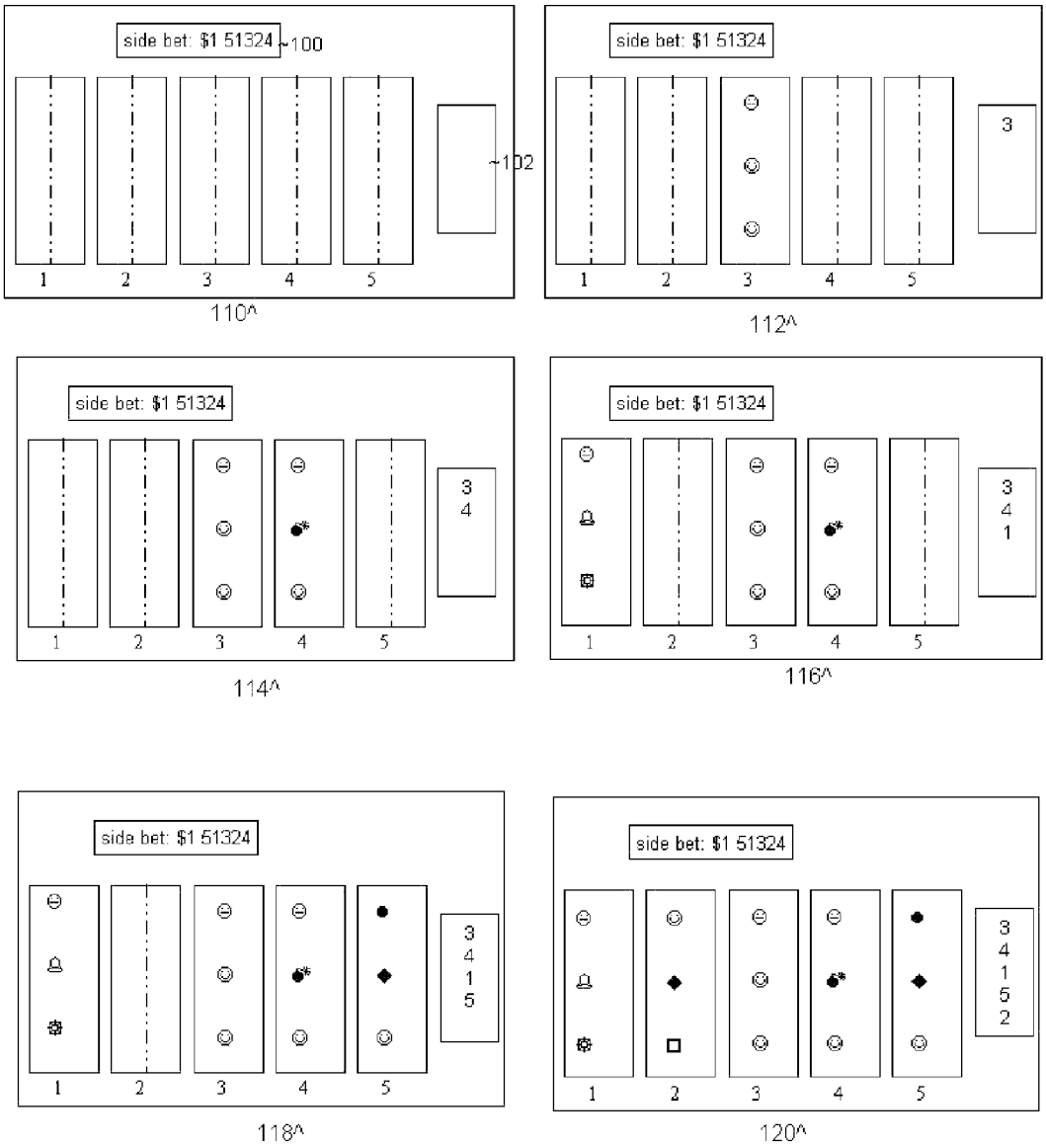
FIG. 1 is a drawing showing six different stages of a slot machine game, according to an embodiment.

Reference will now be made in detail to the presently preferred embodiments of the invention, examples of which are illustrated in the accompanying drawings, wherein like reference numerals refer to like elements throughout.

Embodiments of the invention relate to slot machine games, where typically a player places a wager, presses a button to spin the reels, the reels each stop at a random position, payouts are determined by comparing all paylines played to a predetermined set of winning combinations, and then the determined payouts, if any, are awarded to the player based on the wager. Additional features can augment the excitement of a player and may also result in increased action for the casino.

A slot machine that Prior art slot machines typically stop the spinning of the reels from left to right. Thus, all reels are spun, then reel 1 stops, then reel 2 stops, then reel 3 stops.

The present inventive concept relates to a slot machine which has reels that do not necessarily stop in left to right order. The order that the reels stop in can be determined at random. The slot machine can offer the player a side bet(s) that allows a player to bet on an order that the reels stop spinning. This game can be thought of as a "horserace" or other type of race, as the player is betting on his or her predicted finish order.

For example, on a five reel machine, the player may wish to bet that reel 3 stops spinning first, then reel 5, then reel 1, then reel 2, then reel 4. If the player guesses rights, then the player wins the side bet. Note that with a five reel machine (although the present concepts can be applied to a slot machine with any number of reels), there would be 120 (5!) orders in which the reels can stop spinning.

FIG. 1 is a drawing showing six different stages of a slot machine game, according to an embodiment.

A five reel slot machine is illustrated (although of course any number of reels can be used) with a side bet as described herein. The player can enter a reel order and a side bet amount, which can be displayed in side bet output 100. This can be done by using any input device, such as a keypad, or touching reels in a predicted order, etc. In this example, the player has entered a reel order of 5,4,3,2,1 and a side bet of one dollar. An actual order display 102 can be used to display the actual order the reels stop spinning, as they stop spinning.

The player can make a main wager (on a final reel symbol combination once all of the reels have stopped spinning) and spins the reels of the slot machine, as known in the art. In the first phase 110, all five reels are spinning. The order the reels stop in is determined randomly.

In a second phase 112, the third reel stops spinning first in this example. In a third phase 114, the fourth reel stops. In a fourth phase 116, the first reel stops. Then, in a fifth phase 118, the fifth reel stops. In a sixth phase 120, the second reel stops last.

The delay between reels stopping can be any amounts, such as 0.1-2 seconds. Since in this example, the final (or actual) stopping order in this example (3,4,1,5,2) is different from the order (predicted order) the player wagered on (5,1,3,2,4) the player loses his or her side bet. If the player had correctly guessed the order that the reels stopped in (3,4,1,5,2) (of course before the first reel had stopped), then the player would have won the side bet. The order the reels stop is determined randomly and does not affect payouts/play of the main slot game.

A paytable can be used on the side bet as well. For example, if the player gets all five reels in the correct order, he can win a maximum amount (e.g., $50). If the player gets the first three correct, he can win a lower amount (e.g., $10). Table I below is an exemplary paytable for a side bet as described herein. It is noted this is merely one example, and any number of payouts can be included (e.g., 1 to 4 on a five reel machine). Thus, in the example in the FIG. 1, if the player guessed 3,4,1,2,5, he would have guessed the first three reels to stop spinning correctly and would win a smaller prize (e.g., $10). If the player guessed 3,2,4,5,1, the player would win $1 since the player guessed the first reel correctly. If the player guessed 4,3,1,5,2 the player would not qualify to win an award using Table I, since while the player did correctly guess one reel (the first reel which finished third), paytable I would only give credit for one correctly guessed reel if it was the initial reel to stop spinning. The paytables shown herein can be based on a $1 bet (although of course any other base amount can be used. The paytable could alternatively be illustrated in a ratio form (e.g., instead of $50 the paytable could indicate 50:1). The payouts illustrated here are merely examples and do not reflect actual game math.

TABLE I

| Reels correctly guessed | pays |
|---|---|
| All 5 | $50 |
| First 3 | $10 |
| First 1 | $1 |
| All others | $0 |

The winning combinations in Table I apply to reels the player guessed (or the machine picked for the player) which do not give credit for reels correctly guessed but which are not correctly guessed in sequential order up to the correctly guessed reel. In contrast, the paytable in Table II applies to correctly guessed reels which occur in any order.

TABLE II

| Reels correctly guessed | pays |
|---|---|
| All 5 | $50 |
| Any 3 | $10 |
| Any 1 | $1 |
| All others | $0 |

Thus, for example, using the paytable in Table II (and the actual order illustrated in FIG. 1), if the player guessed 4,3, 1,2,5, the player has guessed one reel correctly (the first reel finished third) and thus the player wins $1. If the player guessed 4,3,1,5,2, the player would win $10 since the player guessed a finishing order for three reels out of the five.

Figure 2:
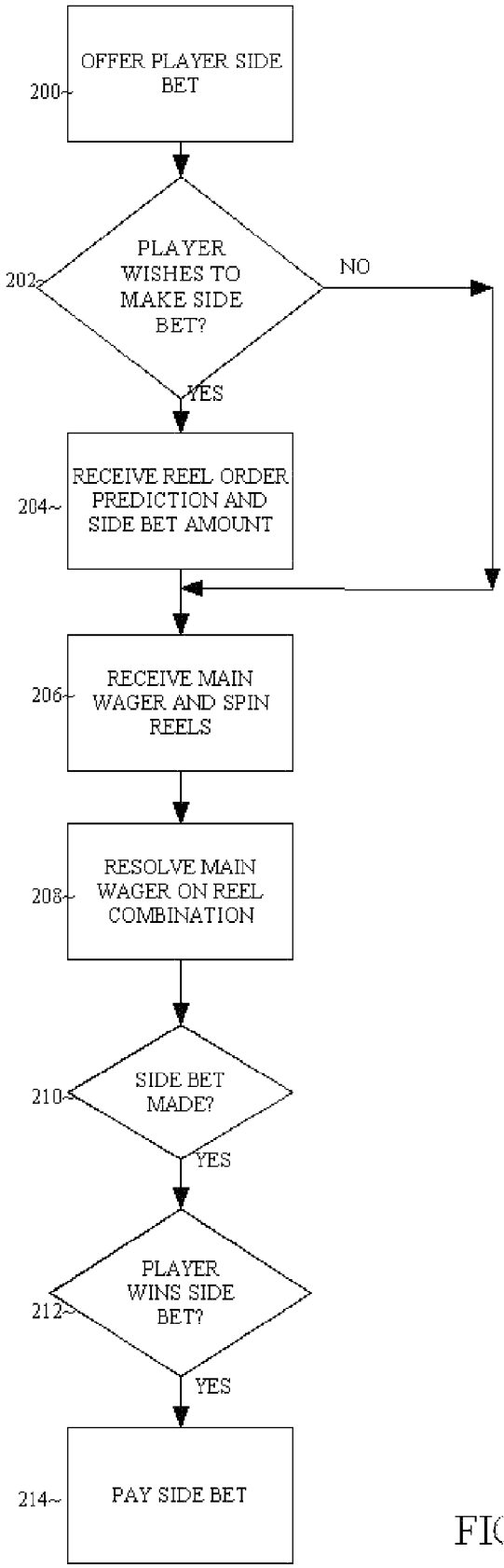
FIG. 2 is a flowchart illustrating an exemplary method of implementing a slot machine game, according to an embodiment.

FIG. 2 is a flowchart illustrating an exemplary method of implementing a slot machine game, according to an embodiment.

The method can start with operation 200, which offers the player the option to make the side bet. The offer can be made electronically or physically printed on the machine instructions.

From operation 200, the method can proceed to operation 202, which determines whether the player wishes to make the side bet. The player can indicate his acceptance to make a side bet by pressing a button (either physical or virtual on a touch screen). If the player does not wish to make the side wager, the player can either do nothing, or alternatively press a button declining the side wager. If the player does not wish to make the side wager, then the method can proceed to operation 206 wherein the slot game proceeds as normal.

In operation 202, if the player wishes to make the side wager, then the method can proceed to operation 204, which receives the side bet from the player (e.g., the money for the side wager can be automatically deducted from the player's credit meter). The player can either indicate how much the player wishes to wager on the side bet, or depending on the game rules, the side bet may simply be a fixed amount (e.g., $1). The player can also select the predicted order of the reels to finish. This can be done in a number of ways, for instance the player can touch each reel on the display in sequence in the order that the player predicts. Alternatively, the player can touch indicators for each reel to indicate the predicted reel sequence. Alternatively, the slot machine game can select a predicted reel order either randomly or using a predetermined set of order(s).

The method can then proceed to operation 206, which receives the main wager and spins the reels on the slot machine, as known in the art. As an alternative to the side wager bet being collected from the player in operation 204, the side wager bet can instead be collected in operation 206 along with the main wager. The main wager pays on a final combination of symbols on the reels after all of the reels have stopped spinning, as known in the art. The reels will spin in an actual order, which is typically determined randomly. Typically, when a slot machine is about to spin, the slot machine predetermines where each reel will stop, and the spinning/delays for each reel are merely to create a suspension effect for the player. Traditionally, the reels stop from left to right. Using the current method, actual order that the reels will stop in is determined randomly. For example, the random order can still be from left to right (e.g., 1,2,3,4,5) or right to left (5,4,3,2,1) or other random order (e.g., 4,3,1,2,5). For example, in the latter random order, all reels will spin, then the fourth reel stops first, then the third reel stops second, then the first reel stops third, then the second reel stops fourth, and then the fifth reel stops last. There would be 5! (5 factorial) different actual orders that the reels could stop in. The order that the reels stop in typically has no effect on the payouts on the main wager.

From operation 206, the method can proceed to operation 208, which resolves the main wager based on a resulting combination of symbols on the reels using a paytable and the amount of the main wager. Thus, the player would lose his main wager or win his main wager (and be dispensed any main award amount). This can be done as known in the art.

From operation 208, the method can proceed to operation 210, which determines if the side bet was made. If not, then the game ends, and a new game can begin (not pictured).

If the side bet was made, then the method can proceed to operation 212, which determines whether the player wins the side bet. This can be done by comparing the actual order that the reels stopped (in operation 206) to the predicted order (set in operation 204) to determine a correlation, and determines an award based on the correlation using a paytable. For example, if the predicted order exactly matches the actual order, then the player can win a predetermined award (e.g., $100) or a payout on his side bet wager (e.g., 100:1).

If the player wins the side bet, then the method can proceed to operation 214, which actually dispenses the determined award for the side bet to the player. The award for the side bet can also be dispensed simultaneously (or near simultaneously) with the main award amount from the main wager. It is possible that the player would not win a main award amount but win a side bet award, or not win a side bet award but win the main award amount, or win both awards, or win neither awards.

Figure 3:
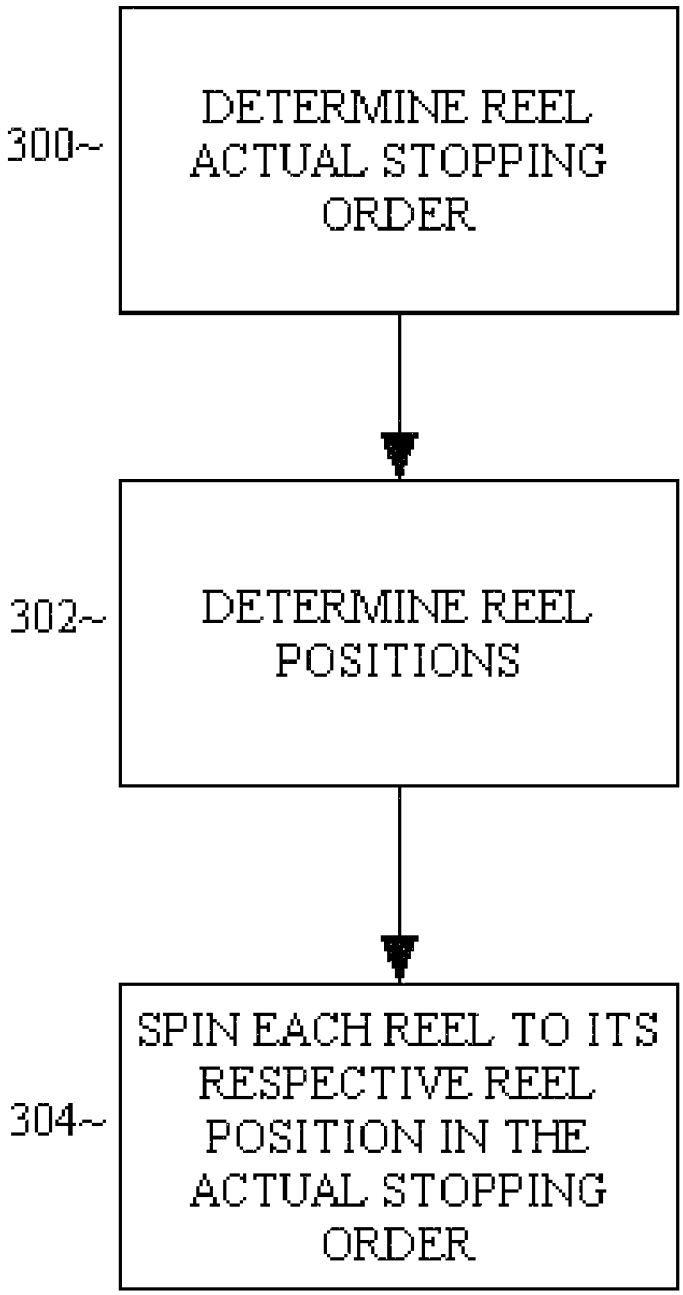
FIG. 3 is a flowchart illustrating a method to output results of a reel spin, according to an embodiment.

FIG. 3 is a flowchart illustrating a method to output results of a reel spin, according to an embodiment.

The method can start with operation 300, which determines an actual reel stopping order. This can be done by picking sequential random numbers without replacement. For example, on a five reel machine, a first random number can be selected from 1 to 5, representing the first reel that will stop. Then, a second random number can be selected from 1 to 5 (but the prior selected number cannot be selected). Then, a third random number can be selected from 1 to 5 (but the two prior selected numbers cannot now be selected). Then, a fourth random number can be selected from 1 to 5 (but the three prior numbers cannot be selected). Lastly, the fifth number will be the remaining number not previously selected. This sequence of numbers will be the stopping order for the reels.

From operation 300, the method can proceed to operation 302, which determines the reel positions. This can be done as known in the art. For example, if a reel has N reel stops, then the stopping position (reel stop) for that reel can be a random number from (1 to N).

From operation 302, the method can proceed to operation 304, which spins each reel to its respective stopping position (determined in operation 300), in the actual order determined in determined in operation 300. The reels can stop in the actual order by spinning the first reel in the actual order sequence (the spin may take a shot time, e.g., one quarter second), then a short delay may pass (e.g., a very small fraction of a second), then the next reel in the actual order sequence may spin, and so on.

In a further embodiment, a player may simply bet on which of the reels will finish first. Thus, in a five reel game, the player can pick which reel out of the five he predicts will finish first and will be paid only if that reel wins (e.g., the player can be paid 4:1). Alternatively, the player can predict which two reels he thinks will finish first and will be paid only if these first two reels finish first (either in the order predicted or any order). This is similar to an exacta or quinella in horse-racing. For example, the player can predict that the first two reels that will stop are 3 and 4. Thus, if the final order is: 3, 4, *, *, * (where * means any other reel) or 4, 3, *, *, *, then the player has won (in either case), but otherwise the player would lose.

In fact, any known horse racing bets can be applied to this method, wherein each of the reels can be considered a separate horse. For example, triples, trifectas, etc., can also be implemented.

In a further embodiment, a player may bet on which of two or more reels will finish first. Thus, in a five reel game, the player can pick 2 reels, and then select which reel will stop first. Thus, for example, the player can make a side bet, and then pick reel 1 and reel 3, and the predict which reel (1 or 3) will finish first. If the player predicts correctly, the player will win the side bet otherwise the payer will lose the side bet. In this example, the chances of the player picking correctly is of course 50%.

In a further embodiment, the player can choose a selected number of reels he or she wishes to predict, and then make a (or receive a random) prediction containing a number of entries equal to the selected number of reels. For example, in a five reel game, the player can choose a selected number of four reels. Then the player can pick four reels out of the five (e.g., reel 4, reel 1, reel 3, reel 5) to be a predicted order out of reels (1,2,3,4,5). Then the player can place his or her wagers and spin the reels which results in the actual order. The predicted order can be compared to the actual order, and based on a paytable, the player's wager can be paid (or not paid if the side wager is a loser).

The methods described herein can be applied to any type of slot game, mechanical or electronic (with results being displayed on an output device such as an LCD), any number of reels (e.g. 1 to 6). It can also be applied to electronic versions of slot machines which can be served to a client through a communications network such as an LAN in a casino or the Internet to a home player.

Figure 4:
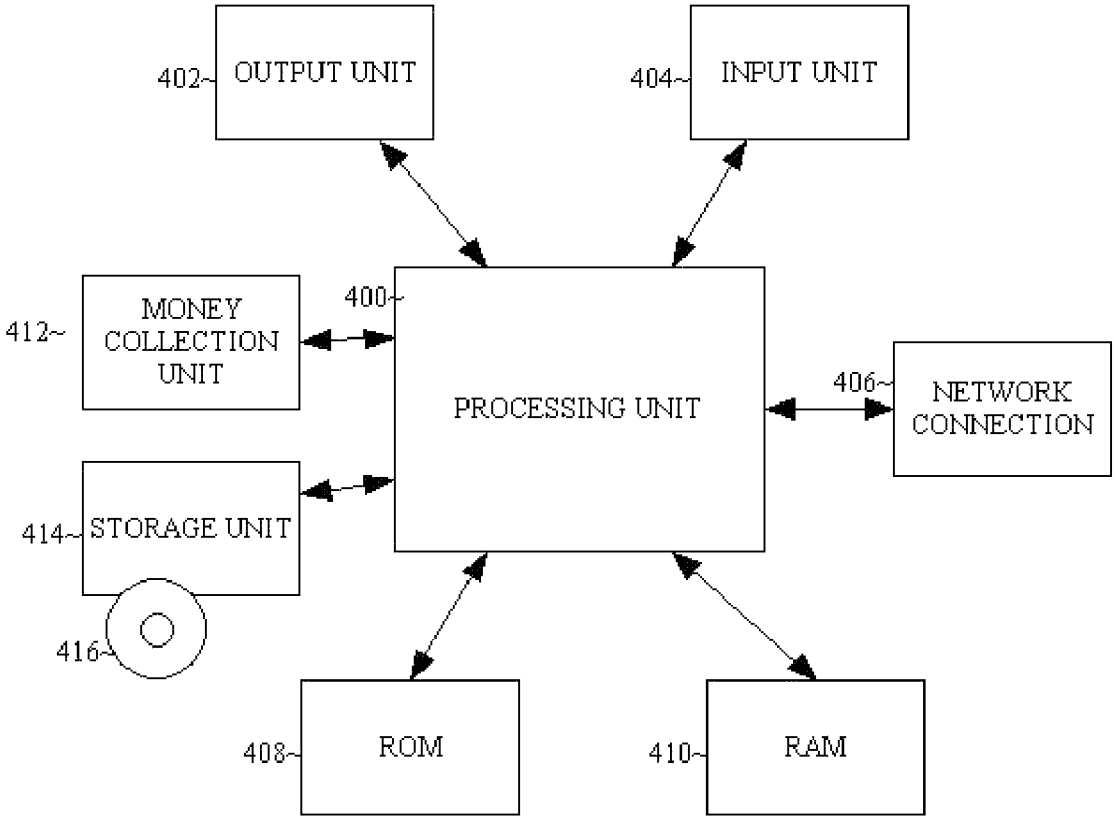
FIG. 4 is a block diagram of one example of hardware that can be used to implement the method, according to an embodiment.

FIG. 4 is a block diagram of one example of hardware that can be used to implement the method, according to an embodiment.

A processing unit 400 (which can comprise a microprocessor and related components) can be connected to an output unit 402 (e.g., LCD or touch screen, etc.), an input unit 404 (e.g. a touch screen, keyboard, buttons, etc.), a network connection 406 (e.g. connection to a casino server or the Internet or other communication network), a ROM 408, a RAM 410, and any other hardware known in the art needed to implemented a digital version of the game (not pictured). The game can also be served to a remote client playing at an online casino over a computer communications network (such as the internet). A money collection unit 412 can be used to receive cash (or other payment from such as electronic payment) and credit. A storage unit 414 can be a CD-ROM drive, a DVD-ROM drive, or any device that can read a computer readable storage medium. A CD-ROM 416 (or any other type of computer readable storage medium) can be read by the storage unit 414 and can contain data, assets, programs, etc., in order to implement the methods described herein on an electronic gaming machine such as the one illustrated in FIG. 4.

Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The descriptions provided herein also include any hardware and/or software known in the art and needed to implement the operations described herein. All components illustrated herein may also optionally communicate with any other illustrated or described component.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A computer-implemented method to use a gaming machine to play a slot machine game, the method comprising using a processing unit of the gaming machine to execute machine-readable instructions adapted for implementing the steps of:

receiving, at the gaming machine, a main-wager and a side-wager from a player;

receiving, at the gaming machine, an input identifying a predicted order that slot reels of the gaming machine will stop spinning;

spinning the slot reels and stopping the slot reels in an actual order determined randomly by the gaming machine;

comparing, at the gaming machine, the predicted order to the actual order to determine whether the player won the side-wager;

determining, at the gaming machine, whether the player won the main-wager for symbol combinations on the slot reels after stopping the slot reels; and paying, using the gaming machine, a first award if the player won the side-wager and a second award if the player won the main-wager.

2. The method as recited in claim 1, wherein receiving the input identifying the predicted order comprises the gaming machine receiving a predicted order of slot reels entered by the player using an input device of the gaming machine.

3. The method as recited in claim 1, wherein the input identify the predicted order comprises a predicted order of slot reels randomly determined by the gaming machine.

4. The method as recited in claim 1, wherein the input identifying the predicted order comprises a predicted order of slot reels predetermined by the gaming machine.

5. The method as recited in claim 1, further comprising:

determining, at the gaming machine, an amount of the first award based on a correlation between the predicted order and the actual order.

6. The method as recited in claim 1, further comprising:

determining, at the gaming machine, an amount of the first award according to a paytable based on a number of reel matches between the predicted order and the actual order.

7. The method as recited in claim 1, wherein paying the first award comprises paying a top award if the predicted order exactly matches the actual order, wherein the top award is highest out of any potential award for the side-wager.

8. The method as recited in claim 1, wherein the predicted order comprises a set of entries equal to a total number of the slot reels.

9. The method as recited in claim 1, wherein the predicted order comprises an indication of only a slot reel predicted to finish spinning first.

10. A computer-implemented method to use a gaming machine to play a slot machine game, the method comprising using a processing unit of the gaming machine to execute machine-readable instructions adapted for implementing the steps of:

receiving, at the gaming machine, a side-wager from a player;

identifying, at the gaming machine, a predicted order that slot reels will stop spinning;

spinning the slot reels and stopping the slot reels in an actual order determined randomly by the gaming machine;

comparing, at the gaming machine, the predicted order to the actual order; and determining, at the gaming machine, whether the side-wager wins based on the comparing, and if the side-wager wins, then paying a winning side-wager payout to the player, wherein a main wager is also placed by the player before the spinning and paid according to symbol combinations on the reels after the spinning;

wherein if the predicted order is determined to exactly match the actual order, then the winning side-wager payout pays a top award which is highest out of any potential award for the winning side-wager; and wherein if a first N entries in the predicted order exactly match a first N entries in the actual order, where N<a total number of reels, then the winning side-wager pays a consolation award which is lower than the top award.

11. The method as recited in claim 10, wherein the winning side-wager payout is determined by determining a number of matches between the predicted order and the actual order before an entry in the predicted order does not match the actual order.

12. The method as recited in claim 11, wherein the winning side-wager payout is graduated, wherein a higher number of matches between the predicted order and the actual order before an entry in the predicted order does not match the actual order corresponds to a higher winning side-wager payout.

13. A computer-implemented method to use a gaming machine to play a slot machine game, the method comprising using a processing unit of the gaming machine to execute machine-readable instructions adapted for implementing the steps of:

receiving, at the gaming machine, a side-wager from a player;

receiving, at the gaming machine, an input, entered by the player, identifying a first predicted reel and a second predicted reel;

receiving, at the gaming machine, a main wager from the player;

spinning the slot reels and stopping the slot reels in an actual order;

if the gaming machine determines that either (the first predicted reel stopped first during the spinning and the second predicted reel stopped second during the spinning) or (the second predicted reel stopped first during the spinning and the first predicted reel stopped second during the spinning), then the player wins a payout on the side-wager, otherwise the player loses the side-wager.

14. A computer-implemented method to use a gaming machine to play a slot machine game, the method comprising using a processing unit of the gaming machine to execute machine-readable instructions adapted for implementing the steps of:

receiving, at the gaming machine, an input, entered by a player, designating a subset of reels of the slot machine game;

determining, at the gaming machine, a predicted finishing order that the subset of reels will stop spinning;

receiving, at the gaming machine, a main-wager and a side-wager from the player;

spinning the slot reels and stopping the slot reels;

determining, at the gaming machine, an actual stopping order of the subset of reels;

comparing, at the gaming machine, the actual stopping order of the subset of reels to the predicted finishing order of the subset of reels to determine whether the player won the side-wager;

determining, at the gaming machine, whether the player won the main-wager for symbol combinations on the slot reels after stopping the slot reels; and paying, using the gaming machine, a first award if the player won the side-wager and a second award if the player won the main-wager.

15. The method as recited in claim 14, wherein the reels are exactly five reels, the subset of reels are exactly three reels out of the five reels, and the predicted finishing order is only one reel out of the subset of three reels.

16. The method as recited in claim 14, further comprising:

receiving, at the gaming machine, a selection, entered by the player, identifying a number of reels in the subset of reels.

17. The method as recited in claim 14, wherein determining the predicted finishing order comprises the gaming machine receiving an input, entered by the player, designating the predicted finishing order.

18. The method as recited in claim 14, wherein determining the predicted finishing order comprises the gaming machine generating the predicted finishing order randomly.

19. The method as recited in claim 14, wherein determining the predicted finishing order comprises the gaming machine determining a predicted finishing order predetermined by the gaming machine.

* * * * *